US006857192B1

(12) United States Patent
Summers et al.

(10) Patent No.: US 6,857,192 B1
(45) Date of Patent: Feb. 22, 2005

(54) DUAL BLADE UTILITY KNIFE

(76) Inventors: Guy Summers, 1295 Friendship La., West Colorado Springs, CO (US) 80904; Rennie Summers, 1295 Friendship La., West Colorado Springs, CO (US) 80904

( * ) Notice: Subject to any disclaimer, the term of this patent is extended or adjusted under 35 U.S.C. 154(b) by 0 days.

(21) Appl. No.: 10/649,915

(22) Filed: Aug. 26, 2003

(51) Int. Cl.[7] ..... B26B 1/08; B26B 5/00
(52) U.S. Cl. ..... 30/294; 30/162; 30/299
(58) Field of Search ..... 30/143, 152, 162, 30/279.2, 287, 294, 299, 335; 7/118, 158, 160; D8/98

(56) References Cited

U.S. PATENT DOCUMENTS

| | | | | | |
|---|---|---|---|---|---|
| 829,353 | A | * | 8/1906 | Rand | 452/17 |
| 1,843,223 | A | | 2/1932 | Hasseler | 30/353 |
| D137,451 | S | * | 3/1944 | Harstad | D8/98 |
| 2,593,601 | A | | 4/1952 | Pollak | 30/2 |
| 2,770,879 | A | * | 11/1956 | Seymour | 30/293 |
| 2,810,194 | A | | 10/1957 | Unsinger | 30/321 |
| 2,906,021 | A | | 9/1959 | Cromoga | 30/293 |
| 3,445,931 | A | | 5/1969 | Knudson | 30/287 |
| 3,478,427 | A | * | 11/1969 | Tims, Jr. | 30/293 |
| 3,748,742 | A | * | 7/1973 | Bigler et al. | 30/294 |
| 3,791,033 | A | | 2/1974 | Regan | 30/287 |
| 3,839,788 | A | | 10/1974 | Addis | 30/287 |
| 4,157,617 | A | | 6/1979 | Frith | 30/294 |
| 4,198,751 | A | | 4/1980 | Egbert | 30/286 |
| 4,316,324 | A | | 2/1982 | Cochran | 30/162 |
| 4,587,735 | A | | 5/1986 | Walters et al. | 30/286 |
| 4,601,102 | A | | 7/1986 | Phillips | 30/123.5 |
| 4,802,279 | A | | 2/1989 | Rowe | 30/155 |
| D310,474 | S | | 9/1990 | Bartsch et al. | D8/99 |
| 4,953,293 | A | * | 9/1990 | Sterlacci | 30/124 |
| D311,319 | S | | 10/1990 | McClelland | D8/98 |
| 4,974,320 | A | * | 12/1990 | Pelletier | 30/123 |
| 5,127,162 | A | | 7/1992 | Mansfield | 30/294 |
| 5,269,063 | A | * | 12/1993 | Okada | 30/162 |
| D352,440 | S | | 11/1994 | Perigny | D8/98 |
| 5,495,670 | A | * | 3/1996 | Quinn | 30/162 |
| 5,502,896 | A | * | 4/1996 | Chen | 30/162 |
| D381,886 | S | | 8/1997 | Domenico | D8/98 |
| 6,371,844 | B1 | | 4/2002 | Holler | 30/278 |
| 6,510,612 | B1 | * | 1/2003 | Cybulski | 30/162 |
| 6,532,669 | B1 | | 3/2003 | Starrett | 30/286 |
| 6,543,140 | B1 | * | 4/2003 | Davis | 30/2 |
| 6,578,271 | B1 | | 6/2003 | Macek | 30/279.2 |

* cited by examiner

*Primary Examiner*—Hwei-Siu Payer
(74) *Attorney, Agent, or Firm*—Holland & Hart LLP

(57) ABSTRACT

The present invention provides a dual blade utility knife useful in various fields. In particular, the dual blade utility knife contains a fixed cutting element contained in a gap that inhibits injury or accidents, a.k.a. a safety knife. The second cutting element is designed to be retractable. The retractable blade can be retracted during use of the safety blade, inhibiting injury or accidents, but extended to make cuts, such as an initial cut in a material.

15 Claims, 2 Drawing Sheets

DUAL BLADE UTILITY KNIFE

FIELD OF THE INVENTION

The present invention relates to utility knives and, more particularly, a dual blade utility knife having a fixed cutting element in a safety holder and a retractable cutting element.

BACKGROUND OF THE INVENTION

Knifes are useful tools for various activities including hunting, camping, roofing, carpentry, as well as other industrial and domestic activities. Frequently, these knifes comprise a cutting element that is retractable or foldable into a position that is safe for handling. When extended or unfolded, however, these knives are relatively unsafe to handle because it is relatively easy to cut oneself or others accidentally.

In order to prevent accidental cuts, some knives come in safety holders. These safety holders frequently are designed with a holder having a neck or gap in which the cutting element resides. Frequently, the cutting edge in safety holders is not retractable, but sometimes the cutting edge is retractable. While these knives are safer than regular knives, retractable knives, and foldable knives, they are not very useful. In particular, making the initial cut into a fabric, tarp, hide, or the like is difficult because the cutting edge residing in the safety holder cannot engage the fabric, tarp, hide, or the like until the same can be treaded into the neck. For example, in hunting applications, it would be difficult to use safety knives to remove the hide of an animal without using a separate tool to make an initial piece or the like.

To avoid this, some blades make the safety feature a retractable feature and/or the safety blade moveable. However, this reduces the stability of the blade or safety feature making the solution less than desirable. Also, the safety feature can be forgotten or broken, reducing its effectiveness. Thus, it would be desirous to develop a fixed cutting edge contained in a safety holder that also had a separate retractable tool for making initial cuts in a material such that the material can be tread into the safety holder and cut by the fixed cutting edge.

SUMMARY OF THE INVENTION

To attain the advantages and purposes of the present invention, a utility knife is provided. The utility knife includes a handle, a first cutting edge, and a second cutting edge. The handle comprises a grip and a body. The body having a first end with a plurality of extension forming a gap and a second end with a slot. The first cutting edge is fixedly coupled to the body such that the first cutting resides in the gap between the plurality of extensions. The second cutting edge is slidably coupled to the slot such that it has at least one extended position and at least one retracted position.

The foregoing and other features, utilities and advantages of the invention will be apparent from the following more particular description of a preferred embodiment of the invention as illustrated in the accompanying drawings.

BRIEF DESCRIPTION OF THE DRAWING

The accompanying drawings, which are incorporated in and constitute a part of this specification, illustrate embodiments of the present invention, and together with the description, serve to explain the principles thereof. Like items in the drawings are referred to using the same numerical reference.

DETAILED DESCRIPTION

The present invention will be described with regard to FIGS. 1 and 2. The below description relates to using the dual bladed utility knife, one of ordinary skill in the art on reading the disclosure will recognize that the present invention could be useful in a number of fields, such as, for example, hunting, carpentry, roofing, inventory stocking, fisheries, and the like. Any specific examples of uses mentioned for the present invention should be considered exemplary and non-limiting.

Figure 1:
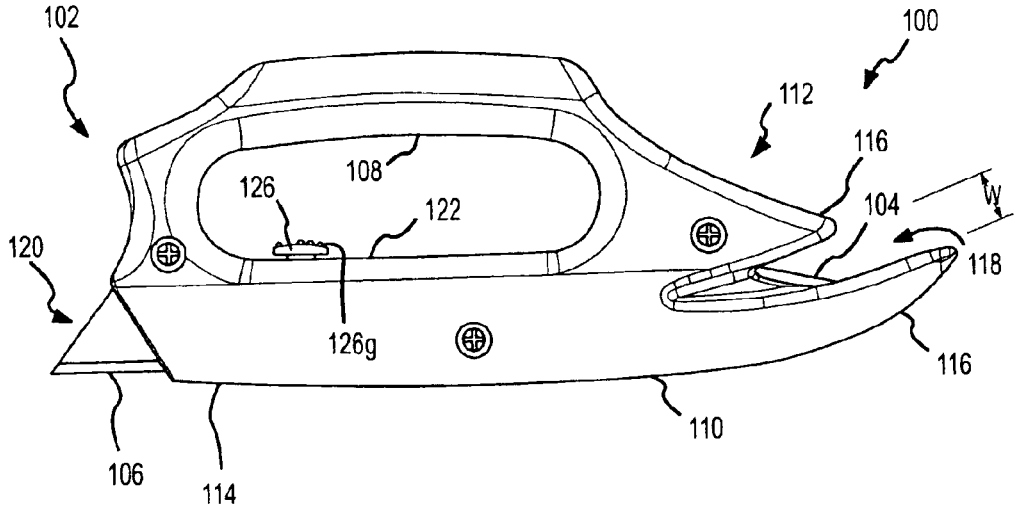
FIG. 1 is an elevation view of a utility knife consistent with one embodiment of the present invention.

Referring first to FIG. 1, an elevation view of a utility knife 100 is shown. Utility knife 100 comprises a handle 102, a first cutting element 104, and a second cutting element 106. Handle 102 comprises a grip portion 108 and a body portion 110. As shown, grip portion 108 and body portion 110 comprise a single molded unit, but could be separate parts coupled together as desired. Actually, as shown to and to facilitate manufacturing, ½ of grip portion and ½ of body portion 110 are a single unit that is mated to the other half (shown in FIG. 2). Body portion 110 has a first end 112 and a second end 114. First cutting element 104 resides on the first end 112 and second cutting element 106 resides on the second end. Also, grip portion 108 is shown as having a generally "C" shape, but that is also exemplary and other style handles are possible, such as, for example, conventional finger grips, a T shaped handle, a L shaped handle, or the like.

First end 112 comprises a pair of forward extensions 116 or prongs that form a gap 118. Gap 118 has a width W that should be sized and/or shaped to inhibit fingers from intentionally or accidentally contacting first cutting element 104.

Figure 2:
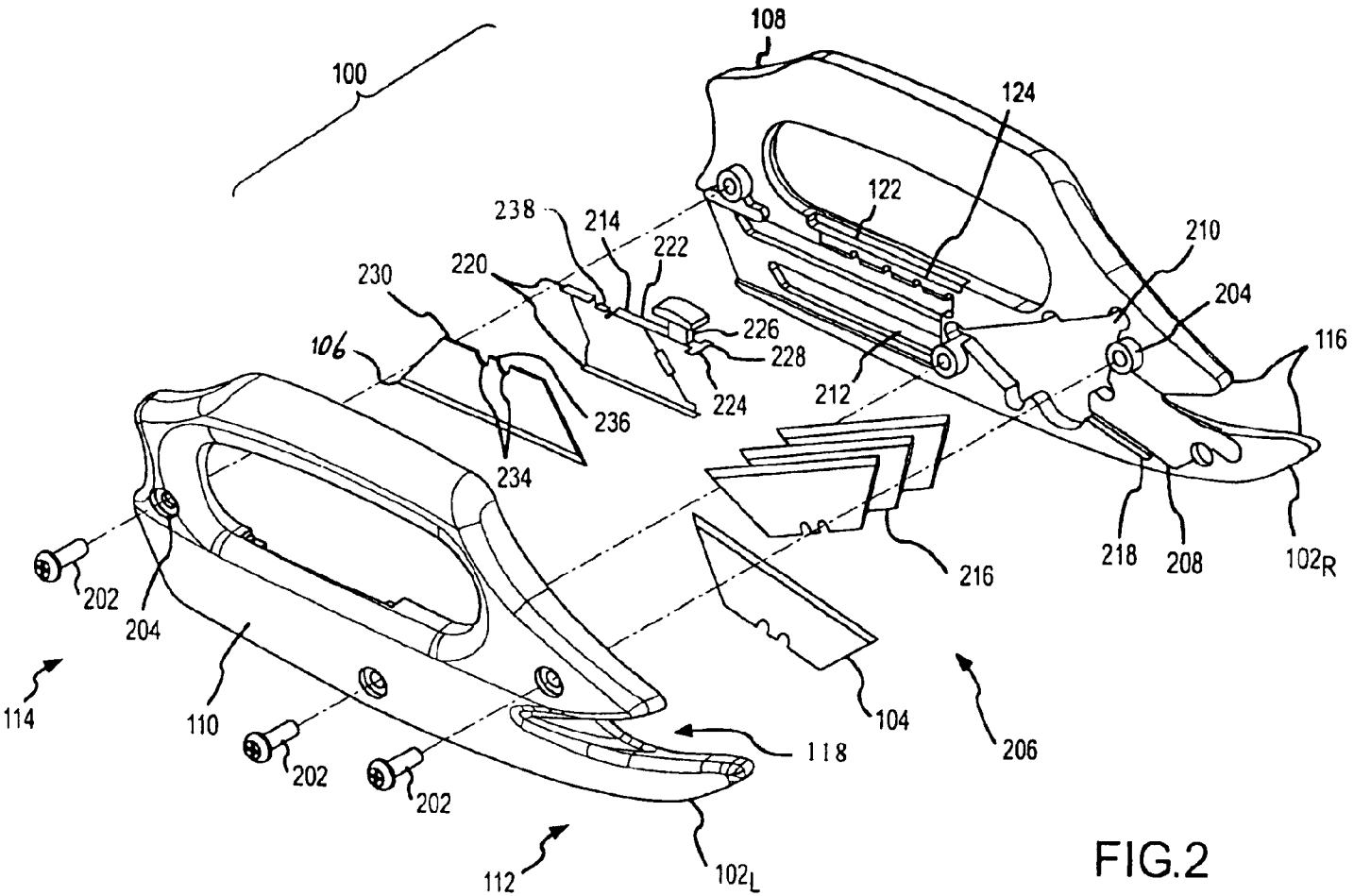
FIG. 2 is an exploded perspective view of the utility knife of FIG. 1.

Second end 114 comprises a cutting element slot 120 and a latch track 122 (best seen in FIG. 2). Latch track 122 contains a plurality of notches 124 (not shown in FIG. 1, but shown in FIG. 2). Slot 120 is designed with sufficient height and width to receive a cutting element, such as a razorblade, awl, pick, saw, serrated blade, or the like. An elongated opening would be used for a razorblade while a circular opening may be used for an awl, etc. While latch track 122, nub 126, and notches 124 are described with relation to second end 114, notches 122 could be anywhere on knife 100. Nub 126 is attached to second cutting element 106, as described below, such that moving nub 126 along latch track 122 moves second cutting element 106 between extended position(s) and retracted position(s). Further, nub 126 is designed as a thumb rest or the like it can be any number of convenient shapes and sizes. Nub 126 may be designed with one or more grooves 126*g* to inhibit slippage.

First cutting element 104 is fixedly attached to body portion 110 such that first cutting element 104 resides in safety gap 118. The term fixedly attached is used to mean first cutting element 104 is not slidably attached to body portion 110. First cutting element 104 could be removed and replaced with a new cutting element as desired. First cutting element 104 is shown as a slicing or sawing type of cutting element, such as a serrated blade or a razorblade, but first cutting element 104 could be a piecing element as well, such as, for example, an awl, a pick, or the like.

Second cutting element 106 is slidably coupled to second end 114. While shown as a blade for slicing, second cutting element 106 could be a tool more adapt for other functions, such as piercing or sawing. Other tools include an awl, pick, saw, wedge, or the like. Making first cutting element 104 and second cutting element 106 the same type of cutting element, however, makes it relatively easy to replace worn or damaged cutting elements. Further, it is envisioned that first cutting element 104 and second cutting element 106 would be standard utility knife blades, such as the type of blades that are readily available at pharmacy stores, convenient stores, and grocery stores.

Referring now to FIG. 2, an exploded view of utility knife 100 is shown. As can be seen, handle 102 actually comprises left handle 102L and right handle 102R connected by elements 202 residing in holes 204. Elements 202 and holes 204 could be, for example, screws and screw holes, nuts and bolts, snap lock fittings, or the like. Handle 102L and handle 102R fit together and form internal space 206. Handle 102 does not need to be made in halves, but it is believed making handle 102 in halves facilitates manufacturing, storage, and cutting element replacement.

Internal space 206 contains a first cutting element holding notch 208, a spare cutting element holding notch 210, a second cutting element slide 212, and a second cutting element slider 214. Spare cutting element holding notch 210 is optional, but if present can hold a number of spare cutting elements 216. Also, second cutting element slider 214 could be integrated into second cutting element 106 to comprise a single piece. If first cutting element 104 and second cutting element 106 are different types of elements, such as, for example, a razorblade and an awl, a second spare cutting element holding notch could be incorporated into internal space 206.

First cutting element holding notch 208 holds first cutting element 104 in place by a frictional engagement between handle 102L and handle 102R. The frictional engagement between handle 102L and 102R is provided by members 202 being tightened or inserted into holes 204 until a sufficient frictional engagement is obtained. Optionally, first cutting element holding notch 208 could have an engaging channel 218, such as a V shaped channel, to facilitate holding first cutting element 104 in place. While other engagements are possible, it is believed the frictional holding force from handle 102 will provide sufficient stability to cutting element 104.

Second cutting element slider 214 comprises a cutting element holder 220, an arm 222, a latch 224, and a connector 226 that is connected to nub 126. Connector 226 extends through and is slidably received in latch track 122 such that nub 126 is accessible above latch track 122 (see FIG. 1). Latch 224 comprises one or more prongs 228 on arm 222. Prongs 228 are sized to engage in notches 124 to hold second cutting element 106 in position. Arm 222 is elastically deformable, such that when nub 126 is not depressed, the elastic force from arm 222 holds prongs 228 in notches 124 that in turn holds second cutting element 106 in place, whether in one or more extended positions and/or in one or more retracted position. When nub 126 is depressed it elastically deforms arm 222 such that prongs 228 are released from notches 124. When released, slider 214 is movable in slide 212, such that second cutting element 106 can slide, such as from an extended position (shown in FIG. 1) to a retracted position. By using more than 2 notches 124, second cutting element 106 can have various extension (or retraction) positions. While it is believed the elastic force supplied by arm 222 is sufficient to hold second cutting element 106 in place, notches 124 can be angled to inhibit inadvertent movement of slider 214.

Holder 220 holds second cutting element 106 in slider 214. Holder 220 can take many forms, such as, a "C" shaped cup that second cutting element 106 snaps into, a clamp, or the like. In the example shown, second cutting element 106 is a conventional razor. Thus, second cutting element 106 has a top edge 230 that has a pair of channels 234 forming a pin 236. Holder 220 has a corresponding catch 238 that fits around pin 236 in channels 234 to hold second cutting element 106.

While the invention has been particularly shown and described with reference to an embodiment thereof, it will be understood by those skilled in the art that various other changes in the form and details may be made without departing from the spirit and scope of the invention.

We claim:

1. A utility knife, comprising:

a handle;

the handle defining an internal space;

a first cutting element; and a second cutting element, wherein the handle comprises a body and a grip, the body having a first end, a second end, and at least one notch, the first end comprising a plurality of extensions forming a gap, the second end comprising a slot;

the first cutting element being fixedly coupled to the first end such that the first cutting element resides in the gap formed by the plurality of extensions;

the second cutting element being slidably coupled to the second end such that the second cutting element has at least one extended position and at least one retracted position; and the second cutting element being releasably coupled to the at least one notch, the at least one notch being located to hold the second cutting element in a position consisting of at least one of the at least one extended position and the at least one retracted position, and wherein the handle further comprising:

a second cutting element slide, the second cutting element slide resides in the internal space towards the second end;

a second cutting element holder slidably coupled to the second cutting element slide;

the second cutting element is coupled to the second cutting element holder such that the second cutting element can move in the slot along with the second cutting element holder;

an arm having a first end connected to the second cutting element holder and a second end connected to a connector; the connector is coupled to a nub such that the connector is slidably received in a latch track, the arm is elastically deformable; and at least one prong coupled to the arm, the at least one prong being releasably coupled to the at least one notch.

2. The utility knife according to claim 1, wherein the second cutting element comprises a top edge having a plurality of channels forming at least one pin; and the second cutting element holder comprises a latch to fit snuggly about the at least one pin to couple the second cutting element to the second cutting element holder.

3. The utility knife according to claim 1, wherein the second cutting element holder comprising a wall having a "C" shape such that the second cutting element snaps into the "C" shape.

4. A utility knife, comprising:

a handle;

the handle defines an internal space;

a first cutting element; and a second cutting element, wherein the handle comprises a body and a grip, the body having a first end, a second end, and at least one notch, the first end comprising a plurality of extensions forming a gap, the second end comprising a slot;

the first cutting element being fixedly coupled to the first end such that the first cutting element resides in the gap formed by the plurality of extensions;

the second cutting element being slidably coupled to the second end such that the second cutting element has at least one extended position and at least one retracted position; and the second cutting element being releasably coupled to the at least one notch, the at least one notch being located to hold the second cutting element in a position consisting of at least one of the at least one extended position and the at least one retracted position, and wherein the handle further comprising:

a second cutting element slide, the second cutting element slide resides in the internal space towards the second end;

the second cutting element is coupled to the second cutting element slide such that the second cutting element can move in the slot;

an arm having a first end connected to the second cutting element and a second end connected to a connector; the connector is coupled to a nub such that the connector is slidably received in a latch track, the arm is elastically deformable; and at least one prong coupled to the arm, the at least one prong being releasably coupled to the at least one notch.

5. The utility knife according to claim 4, further comprising:

a first cutting element notch, the first cutting element notch resides in the internal space towards the first end such that only a portion of the first cutting element is exposed in the gap.

6. The utility knife according to claim 4, wherein the first cutting element and the second cutting element are selected from the group of cutting elements consisting of a razorblade, a saw, a pick, an awl, and a wedge.

7. The utility knife according to claim 6, wherein the first cutting element and the second cutting element are the same type of cutting element.

8. The utility knife according to claim 4, further comprising:

at least one spare cutting element notch residing in the internal space.

9. A dual blade utility knife comprising:

a handle;

a first cutting edge;

a second cutting element;

an internal space;

an arm;

a connector;

a nub; and at least one prong, wherein the handle comprises a body and a grip, the body having a first end, a second end, a latch track, and at least one notch about the latch track, the first end comprising a plurality of extensions forming a gap, the second end comprising a slot;

the internal space is defined by the handle, the internal space comprising a first cutting edge notch towards the first end and a second cutting element slider towards the second end, wherein the first cutting edge being fixedly coupled in the first cutting edge notch such that a portion of the first cutting edge resides in the gap formed by the plurality of extensions;

the second cutting element being slidably coupled to the second cutting element slider such that the second cutting element has at least one extended position and at least one retracted position;

the arm having a first end coupled to the second cutting element and a second end coupled to the connector;

the connector coupled to the nub and slidably received within the latch track; and the at least one prong coupled to second end of the arm and releasably coupled to the at least one notch such that the second cutting element can move between at least one extended position and at least one retracted position.

10. The dual blade utility knife according to claim 9, wherein the first cutting edge is selected from the group consisting of a razorblade and a serrated blade.

11. The dual blade utility knife according to claim 10, wherein the second cutting element is selected from the group consisting of an awl, a pick, a wedge, a razorblade, and a serrated blade.

12. The dual blade utility knife according to claim 10, wherein the second cutting element is selected to be the same as the first cutting edge.

13. The dual blade utility knife according to claim 9, wherein the at least one notch comprises a plurality of notches and the at least one notch corresponds to the extended position and the at least another notch corresponds to the retracted position.

14. The dual blade utility knife according to claim 13, wherein at least a third notch exists corresponding to a position selected from the group consisting of at least a partial extended position and a partial retracted position.

15. The dual blade utility knife according to claim 9, further comprising at least one spare storage notch.

* * * * *